US012578160B1

(12) United States Patent
Kinnard et al.

(10) Patent No.: US 12,578,160 B1
(45) Date of Patent: Mar. 17, 2026

(54) HIGH-PRESSURE AIR MAGAZINE

(71) Applicant: VirTra, Inc., Tempe, AZ (US)

(72) Inventors: John B. Kinnard, Mesa, AZ (US); Robert D. Ferris, Tempe, AZ (US); Daniel Sherwood, Tempe, AZ (US); Douglas R. Clark, Phoenix, AZ (US); Zachary J. Wilsterman, Tempe, AZ (US); Matthew D. Burlend, Tempe, AZ (US)

(73) Assignee: VirTra, Inc., Tempe, AZ (US)

( * ) Notice: Subject to any disclaimer, the term of this patent is extended or adjusted under 35 U.S.C. 154(b) by 980 days.

(21) Appl. No.: 17/330,166

(22) Filed: May 25, 2021

Related U.S. Application Data

(60) Provisional application No. 63/030,189, filed on May 26, 2020.

(51) Int. Cl.
*F41A 33/06* (2006.01)

(52) U.S. Cl.
CPC ..... *F41A 33/06* (2013.01)

(58) Field of Classification Search
CPC ..... F41A 33/06; F41A 21/26
See application file for complete search history.

(56) References Cited

U.S. PATENT DOCUMENTS 2,731,975 A * 1/1956 Boals ..... G05D 16/107 137/116.5
3,834,413 A * 9/1974 Peterson ..... F04B 49/24 137/115.18
4,171,708 A * 10/1979 Pareja ..... F16K 17/0406 417/311

(Continued)

FOREIGN PATENT DOCUMENTS

DE 102013225966 6/2015
DE 102015211619 A1 * 12/2016 ..... F41A 33/06

(Continued)

OTHER PUBLICATIONS

Translation of DE102015211619A1 (Year: 2016).*

(Continued)

*Primary Examiner* — Eugene L Kim
*Assistant Examiner* — Alyssa M Hylinski
(74) *Attorney, Agent, or Firm* — Kenneth C. Booth; Booth Udall, PLC

(57) ABSTRACT

A high-pressure air magazine with an outer housing, a high-pressure chamber formed within the outer housing, a fill valve disposed between the high-pressure chamber and a fill port, and an air regulator configured to selectively pass air from the high-pressure chamber to a low-pressure chamber within the outer housing. The air regulator has a regulator ball valve positioned between the high-pressure chamber and the low-pressure chamber. A spring biases the regulator ball valve to a closed position. A regulator valve screw is configured to adjust a magnitude of the bias on the regulator ball valve. A regulator piston in contact with the regulator ball valve is configured to push the regulator ball valve to an open position when pressure within the low-pressure chamber lowers past a predetermined pressure. A regulator piston support nut is configured to adjust the predetermined pressure.

20 Claims, 5 Drawing Sheets

(56) References Cited

U.S. PATENT DOCUMENTS

| | | | | |
|---|---|---|---|---|
| 7,032,611 | B1 * | 4/2006 | Sheng | G05D 16/103 137/557 |
| 7,334,598 | B1 * | 2/2008 | Hollars | G05D 16/106 251/332 |
| 7,975,714 | B2 * | 7/2011 | Newman | F16K 17/16 137/68.19 |
| 8,827,706 | B2 | 9/2014 | Hogan, Jr. | |
| 9,310,812 | B2 * | 4/2016 | Costle | G05D 16/106 |
| 10,436,539 | B2 | 10/2019 | Tiberius et al. | |
| 11,959,719 | B2 * | 4/2024 | Dvorak | F41A 33/06 |
| 12,345,497 | B1 * | 7/2025 | Clark | F41A 33/06 |
| 2004/0025943 | A1 * | 2/2004 | Wilson, Jr. | F41A 33/06 137/505.25 |
| 2005/0040633 | A1 * | 2/2005 | Butler | B60R 21/272 137/68.13 |
| 2005/0115613 | A1 * | 6/2005 | Wilson, Jr. | G05D 16/103 137/505.18 |
| 2006/0027225 | A1 * | 2/2006 | Homsky | F41B 11/71 124/72 |
| 2012/0129136 | A1 | 5/2012 | Dvorak | |
| 2014/0196267 | A1 * | 7/2014 | Tiberius | F41A 33/02 29/401.1 |
| 2018/0356175 | A1 * | 12/2018 | LaMons | F41A 9/61 |
| 2021/0348720 | A1 * | 11/2021 | Dvorak | F17C 5/00 |
| 2022/0074694 | A1 * | 3/2022 | Dvorak | F41A 33/06 |

FOREIGN PATENT DOCUMENTS

| | | |
|---|---|---|
| DE | 102015211621 | 12/2016 |
| EP | 3296680 | 3/2018 |

OTHER PUBLICATIONS

Tomáš Lukáč, Roman Vítek, Linh Do Duc, Vladimír Horák, Experimental Mechanical Device for Recoil Simulation, Scientific Research and Education in the Air Force—AFASES, pp. 337-344, 2016, Czech Republic.

Military Recoil Weapons and Conversion Kits https://www.lasershot.com/item/158-recoil-conversion-kits.

* cited by examiner

HIGH-PRESSURE AIR MAGAZINE

CROSS REFERENCE TO RELATED APPLICATIONS

This application claims the benefit of the filing date of U.S. Provisional Patent Application 63/030,189 entitled "High Pressure Air Magazine" to Kinnard et. al. that was filed on May 26, 2020, the disclosure of which is hereby incorporated herein by this reference.

TECHNICAL FIELD

Aspects of this document relate generally to a magazine for a weapon, such as an M4, and more specifically to a battery-less, high-pressure air magazine.

BACKGROUND

There is a need for effective training for law enforcement, security officers and military. One aspect of effective training that is lacking is the ability to practice using firearms during simulation activities that feel and behave the same way as during live situations, but is safe for those involved in the simulation. For example, because it is unsafe for trainees to fire live rounds during training activities, it is difficult to create an experience for them to practice responding to specific situations where the firearm responds in the same way as it would in real life. Some simulation systems have involved connecting a firearm to a pressurized tank so that the pressurized tank can provide a simulated recoil. However, this both allows the firearm to "fire" as many times as the user desires and causes the firearm to be used differently than it otherwise would, because it must be physically attached to the tank. These limitations interfere with the effectiveness of the simulation as a training activity.

SUMMARY

Aspects of this document relate to a high-pressure air magazine, comprising an outer housing sized and shaped to couple with a recoil kit for a firearm, the outer housing formed of aluminum, a high-pressure chamber formed within the outer housing and sized to hold a predetermined quantity of pressurized air, a fill valve disposed between the high-pressure chamber and a fill port exposed on a surface of the outer housing, the fill valve configured to couple with a high-pressure nozzle through the fill port to fill the high-pressure chamber with pressurized air, an air regulator fluidly coupled to the high-pressure chamber within the outer housing and configured to selectively pass air from the high-pressure chamber to a low-pressure chamber within the outer housing, the air regulator comprising a regulator ball valve positioned between the high-pressure chamber and the low-pressure chamber, the regulator ball valve biased by a compression spring to a closed position wherein airflow from the high-pressure chamber to the low-pressure chamber is minimized, a regulator valve screw exposed on the surface of the outer housing and configured to adjust a magnitude of the bias on the regulator ball valve created by the compression spring, a regulator piston exposed to the low-pressure chamber and in contact with the regulator ball valve, wherein when a pressure within the low-pressure chamber lowers past a predetermined pressure, the regulator piston is biased by a primary regulator spring to push the regulator ball valve from the closed position to an open position wherein air flows from the high-pressure chamber to the low-pressure chamber until the pressure within the low-pressure chamber reaches the predetermined pressure, and a regulator piston support nut exposed on the surface of the outer housing and configured to adjust the predetermined pressure by adjusting a magnitude of the bias on the regulator piston created by the primary regulator spring, an air release valve disposed between the low-pressure chamber and an air release port exposed on the surface of the outer housing, the air release valve configured to couple with the recoil kit and dispense a burst of air from the low-pressure chamber to the firearm through the recoil kit when the firearm is activated, wherein the burst of air causes the firearm to simulate a recoil of the firearm, and a counter configured to track a number of bursts of air released through the air release valve.

Particular embodiments may comprise one or more of the following features. The high-pressure air magazine may further comprise a burst disk disposed between the high-pressure chamber and the surface of the outer housing, the burst disk configured to fail when the pressure within the high-pressure chamber reaches a predetermined maximum pressure and allow air to exit from the high-pressure chamber. The air regulator may further comprise a secondary regulator spring in series with the primary regulator spring, wherein the secondary regulator spring increases the incremental precision with which the predetermined pressure can be adjusted. The high-pressure air magazine may further comprise the firearm and the recoil kit, wherein the recoil kit is coupled to a magazine well of the firearm, and the outer housing is coupled to the recoil kit. When the number of bursts reaches a predetermined level, the high-pressure air magazine may restrict airflow out of the air release valve until the high-pressure air magazine is detached from the recoil kit and the high-pressure chamber is refilled with pressurized air through the fill valve.

Aspects of this document relate to a high-pressure air magazine, comprising an outer housing sized and shaped to couple with a recoil kit for a firearm, the outer housing comprising aluminum, at least one high-pressure chamber within the outer housing and sized to hold a predetermined quantity of pressurized air, an air regulator fluidly coupled to the high-pressure chamber within the outer housing and configured to selectively pass air from the high-pressure chamber to a low-pressure chamber within the outer housing, the air regulator comprising a regulator ball valve positioned between the high-pressure chamber and the low-pressure chamber, the regulator ball valve biased to a closed position wherein airflow from the high-pressure chamber to the low-pressure chamber is minimized, and a regulator piston exposed to the low-pressure chamber and configured to contact the regulator ball valve, wherein when a pressure within the low-pressure chamber lowers past a predetermined pressure, the regulator piston is biased to push the regulator ball valve from the closed position to an open position wherein air flows from the high-pressure chamber to the low-pressure chamber until the pressure within the low-pressure chamber reaches the predetermined pressure, an air release valve fluidly coupled to the low-pressure chamber and configured to dispense a burst of air from the low-pressure chamber to the firearm when the firearm is activated, wherein the burst of air causes the firearm to simulate a recoil of the firearm, and a counter configured to track a number of bursts of air released through the air release valve.

Particular embodiments may comprise one or more of the following features. The air regulator may further comprise a regulator valve screw exposed on the surface of the outer housing and configured to adjust a magnitude of the bias on the regulator ball valve created by the compression spring. The air regulator may further comprise a regulator piston support nut exposed on the surface of the outer housing and configured to adjust the predetermined pressure by adjusting a magnitude of the bias on the regulator piston created by the primary regulator spring. The high-pressure air magazine may further comprise the firearm and the recoil kit, wherein the recoil kit is coupled to a magazine well of the firearm, and the outer housing is coupled to the recoil kit. When the number of bursts reaches a predetermined level, the high-pressure air magazine may restrict airflow out of the air release valve until the high-pressure air magazine is detached from the recoil kit and the high-pressure chamber is refilled with pressurized air through the fill valve.

Aspects of this document relate to a high-pressure air magazine, comprising at least one high-pressure chamber within an outer housing, an air regulator fluidly coupled to the high-pressure chamber within the outer housing and configured to selectively pass air from the high-pressure chamber to a low-pressure chamber within the outer housing, the air regulator comprising a regulator piston exposed to the low-pressure chamber and in contact with a regulator ball valve, wherein when a pressure within the low-pressure chamber lowers past a predetermined pressure, the regulator piston is biased to push the regulator ball valve from a closed position wherein airflow from the high-pressure chamber to the low-pressure chamber is minimized to an open position wherein air flows from the high-pressure chamber to the low-pressure chamber, and an air release valve fluidly coupled to the low-pressure chamber and configured to dispense a burst of air from the low-pressure chamber to a firearm when the firearm is activated, wherein the burst of air causes the firearm to simulate a recoil of the firearm.

Particular embodiments may comprise one or more of the following features. The regulator ball valve may be positioned between the high-pressure chamber and the low-pressure chamber. The regulator ball valve may be biased to the closed position. The air regulator may further comprise a regulator valve screw exposed on a surface of the outer housing and configured to adjust a magnitude of the bias on the regulator ball valve. The high-pressure air magazine may further comprise a counter configured to track a number of bursts of air released through the air release valve. When the number of bursts reaches a predetermined level, the high-pressure air magazine may restrict airflow out of the air release valve until the high-pressure air magazine is detached from the recoil kit and the high-pressure chamber is refilled with pressurized air through the fill valve. The air regulator may further comprise a regulator piston support nut exposed on a surface of the outer housing and configured to adjust the predetermined pressure by adjusting a magnitude of the bias on the regulator piston. The high-pressure air magazine may further comprise the firearm and a recoil kit for the firearm, wherein the recoil kit is coupled to a magazine well of the firearm, and the outer housing is coupled to the recoil kit. The high-pressure air magazine may further comprise a fill valve disposed between the high-pressure chamber and a fill port exposed on a surface of the outer housing, the fill valve configured to couple with a high-pressure nozzle through the fill port to fill the high-pressure chamber with pressurized air. The high-pressure air magazine may further comprise a burst disk disposed between the high-pressure chamber and a surface of the outer housing, the burst disk configured to fail when the pressure within the high-pressure chamber reaches a predetermined maximum pressure and allow air to exit from the high-pressure chamber.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Figure 1:
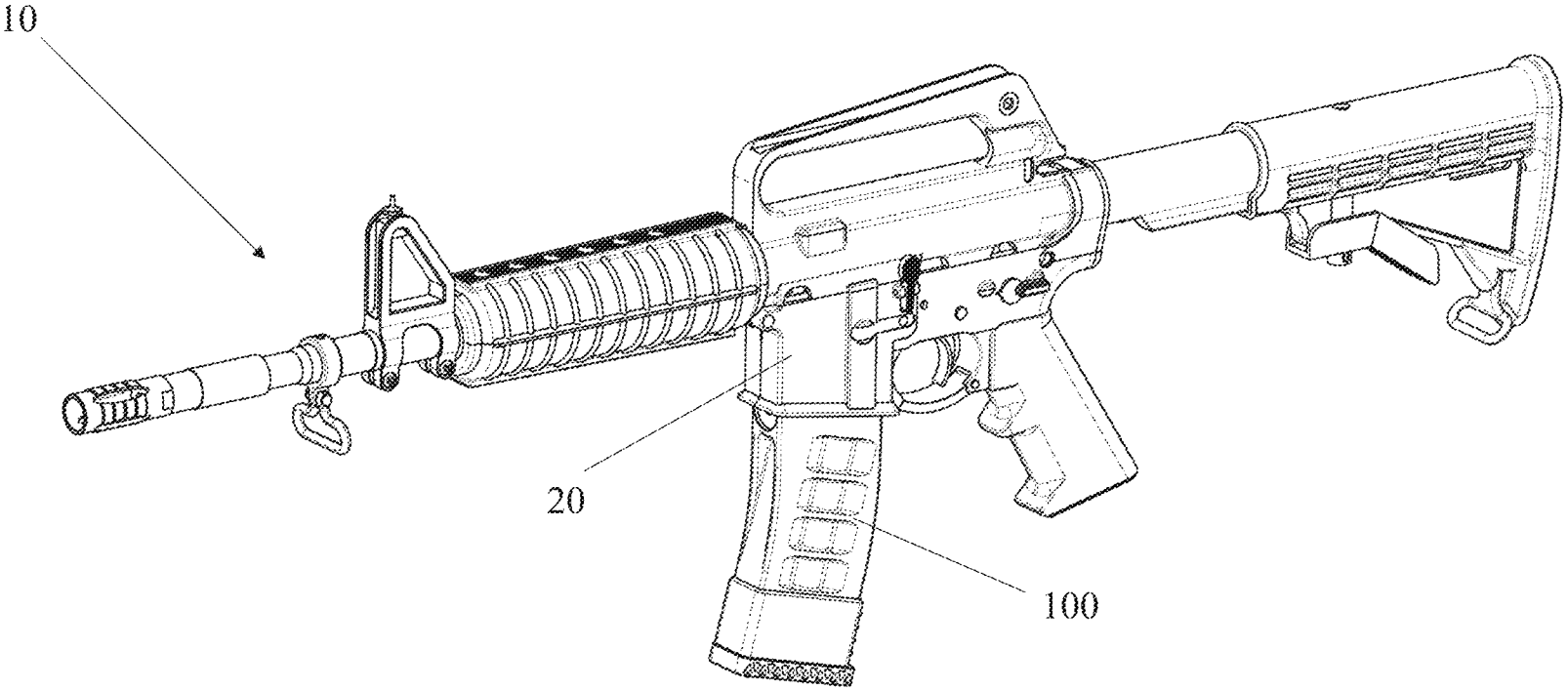
FIG. 1 is a perspective view of a M4 weapon with a high-pressure air magazine attached.
Figure 2:
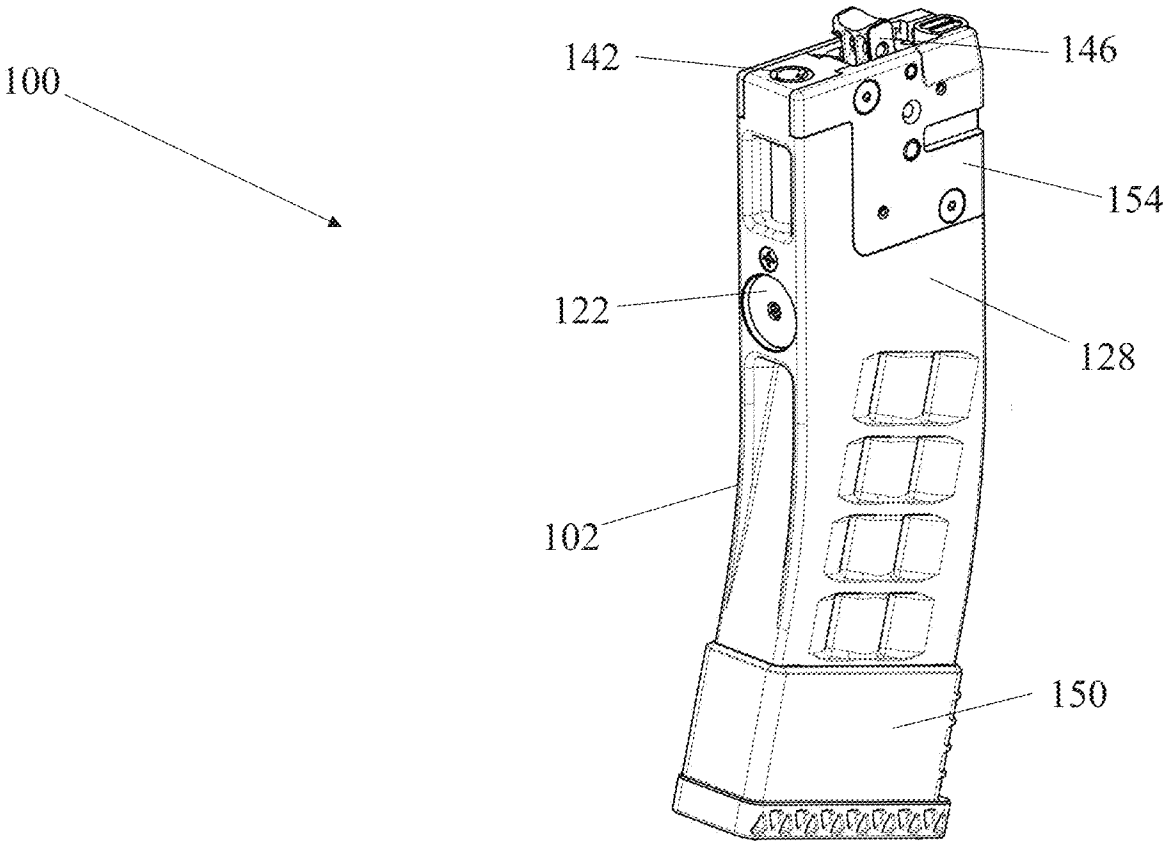
FIG. 2 is a front perspective view of the high-pressure air magazine shown in FIG. 1.
Figure 3:
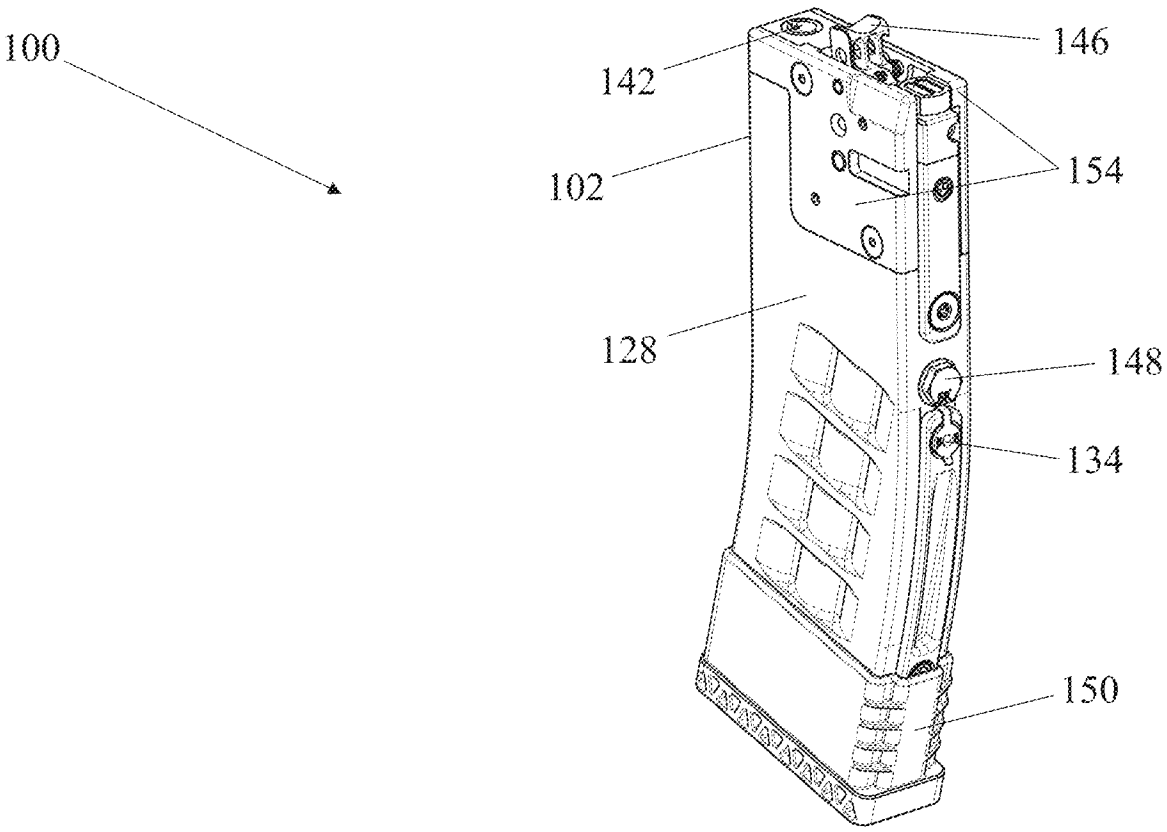
FIG. 3 is a back perspective view of the high-pressure air magazine shown in FIG. 2.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations that are described in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

The present disclosure relates to a high-pressure air magazine 100. The high-pressure air magazine 100 improves training for law enforcement, security officers, and military because it allows a firearm 10 such as an M4 to be used during training without firing bullets. While the drawings show an embodiment of the high-pressure air magazine 100 made for an M4, the principles disclosed herein could be adapted for other firearms as well.

The high-pressure air magazine 100 simulates the recoil of the firearm 10 without requiring that the firearm 10 be physically connected to a pressurized tank or other device. Additionally, the high-pressure air magazine 100 is designed to be similar to a normal magazine in weight, size, and shape so that the firearm 10 feels the same in the trainee's hands. The high-pressure air magazine 100 is configured to track the number of "shots" that a trainee takes and stop simulating the recoil once the number of "shots" reaches a predetermined value. Thus, the trainee has a limited number of shots, similar to when using live rounds. The high-pressure air magazine 100 can be disconnected from the firearm 10 and retain knowledge concerning the number of shots fired, thus simulating having rounds within the magazine. A trainee may use several high-pressure air magazines 100 in conjunction with each other to be able to simulate having to remove an empty magazine once the magazine is out of "shots" and replace it with a fresh magazine. Thus, the high-pressure air magazine 100 enables effective training by creating a simulated firearm 10 that is very similar to the look and feel of the firearm that would be used in live situations.

As illustrated in FIG. 1, the high-pressure air magazine 100 is configured to couple with a firearm 10 in the same way that a conventional magazine with rounds does. In some embodiments, the high-pressure air magazine 100 includes a recoil kit 20. The recoil kit 20 couples with the magazine well of the firearm 10, and the high-pressure air magazine 100 couples with the recoil kit 20. Thus, the recoil kit 20 functions as an interface between the firearm 10 and the high-pressure air magazine 100. In addition, the recoil kit 20 is configured to recognize when the trigger of the firearm 10 is pulled and cause the high-pressure air magazine 100 to simulate a recoil in response.

As shown in FIGS. 2-5, the high-pressure air magazine 100 may comprise an outer housing 102, a high-pressure chamber 104 and a low-pressure chamber 106 both within the outer housing 102, a fill valve 108, an air regulator 110 configured to pass air from the high-pressure chamber 104 to the low-pressure chamber 106, and an air release valve 112. The outer housing 102 is sized and shaped to couple with the firearm 10 or with the recoil kit 20. The outer housing 102 may be formed of a material selected to achieve a balance between the weight of the high-pressure air magazine 100 and its strength. The high-pressure air magazine 100 must have sufficient structural strength to withstand high pressures within the outer housing 102, which may be around 3000 psi and may exceed 7000 psi. Additionally, the high-pressure air magazine 100 should approximate the weight of a loaded magazine. One example of a material that achieves a good weight/strength balance is aluminum, particularly a 6061-T6 aluminum. Other materials may also be used, such as carbon fiber or other metals and alloys. The outer housing 102 may be formed into the shape of a conventional magazine. The outer housing 102 may be formed of multiple parts which are then welded together. Alternatively, the outer housing 102 may be formed of a single piece of material. For example, the outer housing 102 may be molded or may be shaped with a computer numerical control (CNC) machine.

The high-pressure chamber 104 may be a removeable cartridge or may be formed directly into the outer housing 102. The high-pressure chamber 104 is sized to hold a predetermined quantity of pressurized air. The predetermined quantity of pressurized air is based on the number of rounds that a magazine of the firearm 10 typically holds and the amount of air that is expelled from the high-pressure chamber 104 per round. Thus, the size of the high-pressure chamber 104 is determined based on the number of rounds needed, the amount of air expelled per round, and the desired pressure for the high-pressure chamber 104. In some embodiments, the desired pressure for the high-pressure chamber 104 may be between 3,000 and 7,000 psi. The high-pressure chamber 104 may be formed into any shape. In some embodiments, the high-pressure chamber 104 is formed with rounded surfaces for improved force distribution and chamber strength. The high-pressure chamber 104 may be one large cavity or may include multiple cavities. For example, in the embodiment shown in FIG. 5, the high-pressure chamber 104 includes three cavities. The individual cavities may be fluidly joined together so that the pressure within each cavity is equalized. Alternatively, the individual cavities may be fluidly isolated. A chamber plug 114 seals the high-pressure chamber 104 from the outside pressure. In some embodiments, the chamber plug 114 has an O-ring 126 or other seal to prevent air from escaping. In other embodiments, the chamber plug 114 is laser welded or otherwise permanently attached to the high-pressure air magazine 100.

While the cavities described are designed so they can be efficiently drilled in one operation per cavity using a drill bit with a half-dome tip, it is contemplated that a single or double pocket could be created with sufficient volume to both hold adequate air for the operation of a predetermined number of shots (such as 30 recoil shots), even at temperatures below freezing as well as helping to keep the weight of the magazine to within +/−10% of the weight of a real magazine with a full load of bullets. To ensure the finalized magazine reaches this ideal weight range, or even closer tolerances, additional pockets devoid of material could be used in non-critical areas of the high-pressure air magazine 100 so that the overall form and outside dimensions of the high-pressure air magazine 100 are not affected to enhance the real-world experience during the training while reducing the overall weight. By staying true to the look, shape, feel and weight of a real magazine, while avoiding making the high-pressure chamber 104 larger than necessary, training effectiveness is enhanced. If the high-pressure chamber 104 is larger than necessary, the larger chamber volume could cause an external reserve-refill tank to empty faster than if the high-pressure chamber 104 were a smaller, ideal size for operation.

Figure 5:
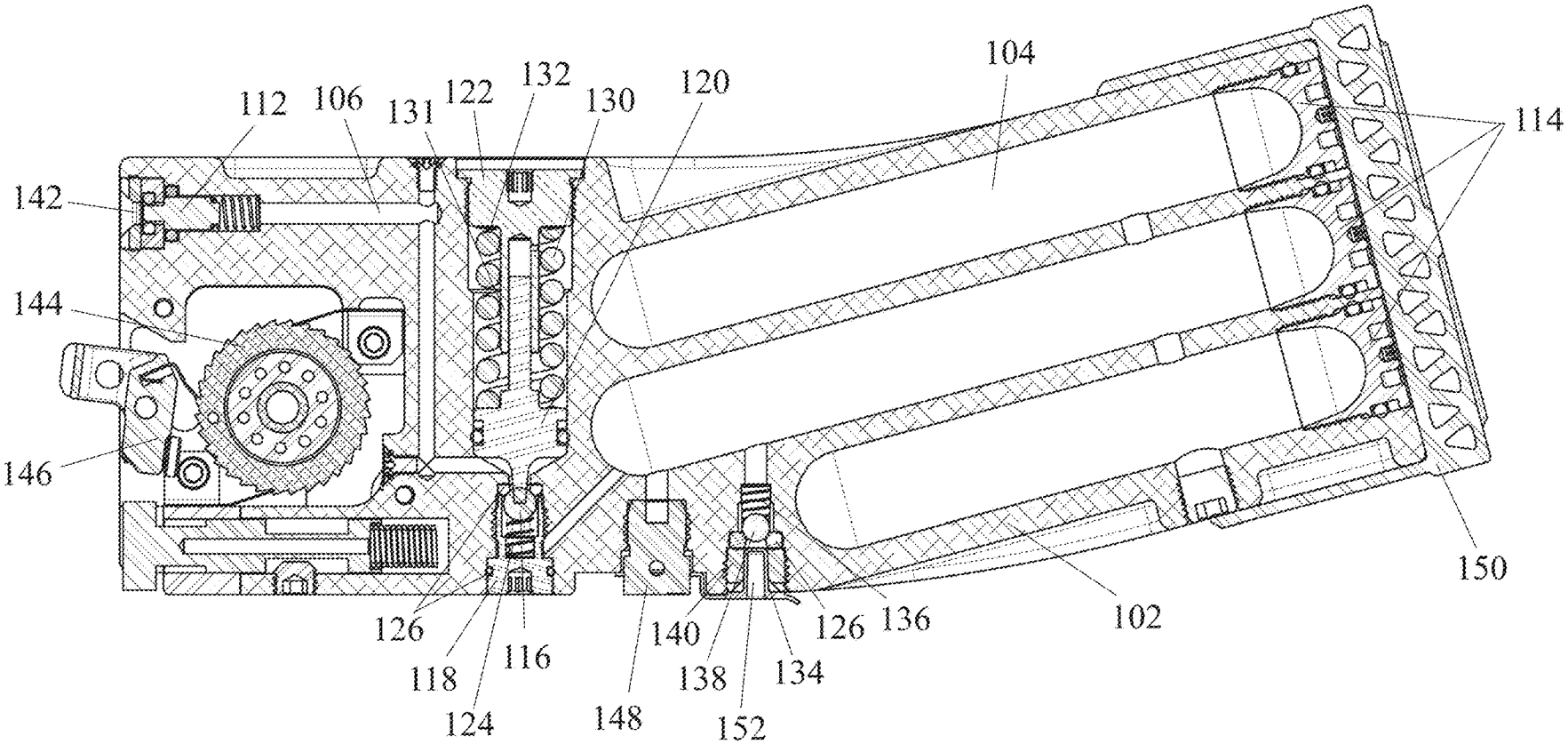
FIG. 5 is a cross section view of the high-pressure air magazine shown in FIG. 2.

The low-pressure chamber 106 may also be a removeable cartridge or may be formed directly into the outer housing 102. As illustrated in FIG. 5, the low-pressure chamber 106 is fluidly coupled to the high-pressure chamber 104 through the air regulator 110 and is fluidly coupled to the air release valve 112. The low-pressure chamber 106 is configured to hold a quantity of air that is sufficient to simulate one recoil of the firearm 10. Thus, each time of the firearm 10 is activated, the low-pressure chamber 106 releases pressurized air through the air release valve 112 to the firearm 10. As disclosed in more detail below, the low-pressure chamber 106 is then refilled with pressurized air from the high-pressure chamber 104 through the air regulator 110.

The air regulator 110 is positioned between and fluidly coupled to the high-pressure chamber 104 and the low-pressure chamber 106 and is configured to selectively pass air from the high-pressure chamber 104 to the low-pressure chamber 106. The air regulator 110 may comprise a regulator ball valve 116, a regulator valve screw 118, a regulator piston 120, and a regulator piston support nut 122. The regulator ball valve 116 may be positioned between the high-pressure chamber 104 and the low-pressure chamber 106 and may be biased by a compression spring 124 to a closed position wherein airflow from the high-pressure chamber 104 to the low-pressure chamber 106 is minimized. An O-ring 126 may be positioned between the regulator ball valve 116 and the low-pressure chamber 106 to further minimize airflow from the high-pressure chamber 104 to the low-pressure chamber 106. The O-ring 126 may have a seat configured to decrease the likelihood that the O-ring enters the opening joining the high-pressure chamber 104 and the low-pressure chamber 106. The regulator valve screw 118 may be positioned adjacent to the compression spring 124 and may be exposed on a surface 128 of the outer housing 102. The regulator valve screw 118 is configured to adjust a magnitude of the bias on the regulator ball valve 116. For example, the regulator valve screw 118 may be threaded into the outer housing 102 and can be screwed towards or away from the compression spring 124, compressing or releasing the compression spring 124. Thus, the bias may be increased by screwing the regulator valve screw 118 toward the compression spring 124 and may be decreased by screwing the regulator valve screw 118 away from the compression spring 124. In particular embodiments, the regulator valve screw 118 may not be included, and the magnitude of the bias on the regulator ball valve 116 may not be adjustable.

The regulator piston 120 is exposed to the low-pressure chamber 106 and is configured to contact the regulator ball valve 116. When the pressure within the low-pressure chamber 106 lowers past a predetermined pressure, the regulator piston 120 is biased by a primary regulator spring 130 to push the regulator ball valve 116 from the closed position to an open position. When the regulator ball valve 116 is in the open position, air flows from the high-pressure chamber 104 to the low-pressure chamber 106 until the pressure within the low-pressure chamber 106 reaches the predetermined pressure, at which point the regulator ball valve 116 returns to the closed position. In the event that the pressure within the high-pressure chamber 104 lowers past the predetermined pressure, the regulator ball valve 116 remains in the open position. In some embodiments, the predetermined pressure may be between 1,000 and 1,500 psi. The predetermined pressure may be selected based on the desired pressure and quantity of air released with each activation of the firearm 10.

During the cycling of the air regulator 110, the regulator piston 120 encounters violent forces from the primary regulator spring 130. These forces and vibration tend to make the regulator piston 120 move off axis. It has been discovered that this off-axis movement can lead to piston seizure in the regulator bore. To alleviate this condition, some embodiments of the regulator piston support nut 122 have a sleeve 131 in which the regulator piston 120 moves back and forth. This helps to keep the regulator piston 120 aligned. Due to space constraints, the sleeve 131 may be positioned within the inside diameter of the primary regulator spring 130 and within the length of the primary regulator spring 130 to fit within the magazine width restrictions. In order to restrict the off-axis movement, the sleeve 131 may include a large engagement-length-to-diameter ratio. Additionally, the sleeve 131 may be made from a material with suitable strength to retain the regulator piston 120 and prevent galling with the regulator piston 120.

In embodiments that have a regulator piston support nut 122, the regulator piston support nut 122 is exposed on the surface 128 of the outer housing 102, with the primary regulator spring 130 positioned between the regulator piston support nut 122 and the regulator piston 120, and is configured to adjust the predetermined pressure by adjusting a magnitude of the bias on the regulator piston 120 created by the primary regulator spring 130. In this regard, the regulator piston support nut 122 functions similar to the regulator valve screw 118. When the regulator piston support nut 122 is screwed towards the primary regulator spring 130, the predetermined pressure is increased because the primary regulator spring 130 exerts a greater bias on the regulator piston 120, and thus greater pressure within the low-pressure chamber 106 is required to prevent the regulator piston 120 from moving the regulator ball valve 116 to the open position. On the other hand, when the regulator piston support nut 122 is screwed away from the primary regulator spring 130, the predetermined pressure is decreased because the primary regulator spring 130 exerts a lesser bias on the regulator piston 120, and thus less pressure within the low-pressure chamber 106 is required to prevent the regulator piston 120 from moving the regulator ball valve 116 to the open position. In particular embodiments, the regulator piston support nut 122 may not be included, and the magnitude of the bias on the regulator piston 120 may not be adjustable.

In particular embodiments, a simple adjustment of the regulator piston support nut 122 also adjusts the pressure of air exerted on the weapon with each shot so that the recoil force can be specifically customized to the firearm 10 into which the high-pressure air magazine 100 will be used. The regulator piston support nut 122 allows the recoil force of each high-pressure air magazine 100 to be individually adjusted as needed. In other embodiments, the regulator piston support nut 122 may not be included, and the recoil force may not be adjustable. Because the air regulator 110 regulates between the high-pressure chamber 104 and low-pressure chamber 106 using the regulator ball valve 116, the regulator valve screw 118, the regulator piston 120, and the primary regulator spring 130, the pressure equilibrium reached maintains a fairly constant pressure in the low-pressure chamber 106 with each recharge, even when the pressure in the high-pressure chamber 104 is reduced. This helps to maintain a more consistent recoil force and feel for the user.

The air regulator 110 may also comprise a secondary regulator spring 132 in series with the primary regulator spring 130. The secondary regulator spring 132 may be a Belleville spring. The secondary regulator spring 132 increases the incremental precision with which the predetermined pressure can be adjusted. For example, adding in the secondary regulator spring 132 adjusts the spring constant for the system, and careful selection of the spring constant of the secondary regulator spring 132 allows the predetermined pressure to be adjusted with more precision. By adjusting the size of the high-pressure chamber 104, the regulator spring strength and the air flow volume as explained herein, the optimal mix of air usage, recoil kit force strength per shot and the rate of decrease of recoil shot force from the first to the last shot fired can be better and more efficiently controlled.

Figure 4:
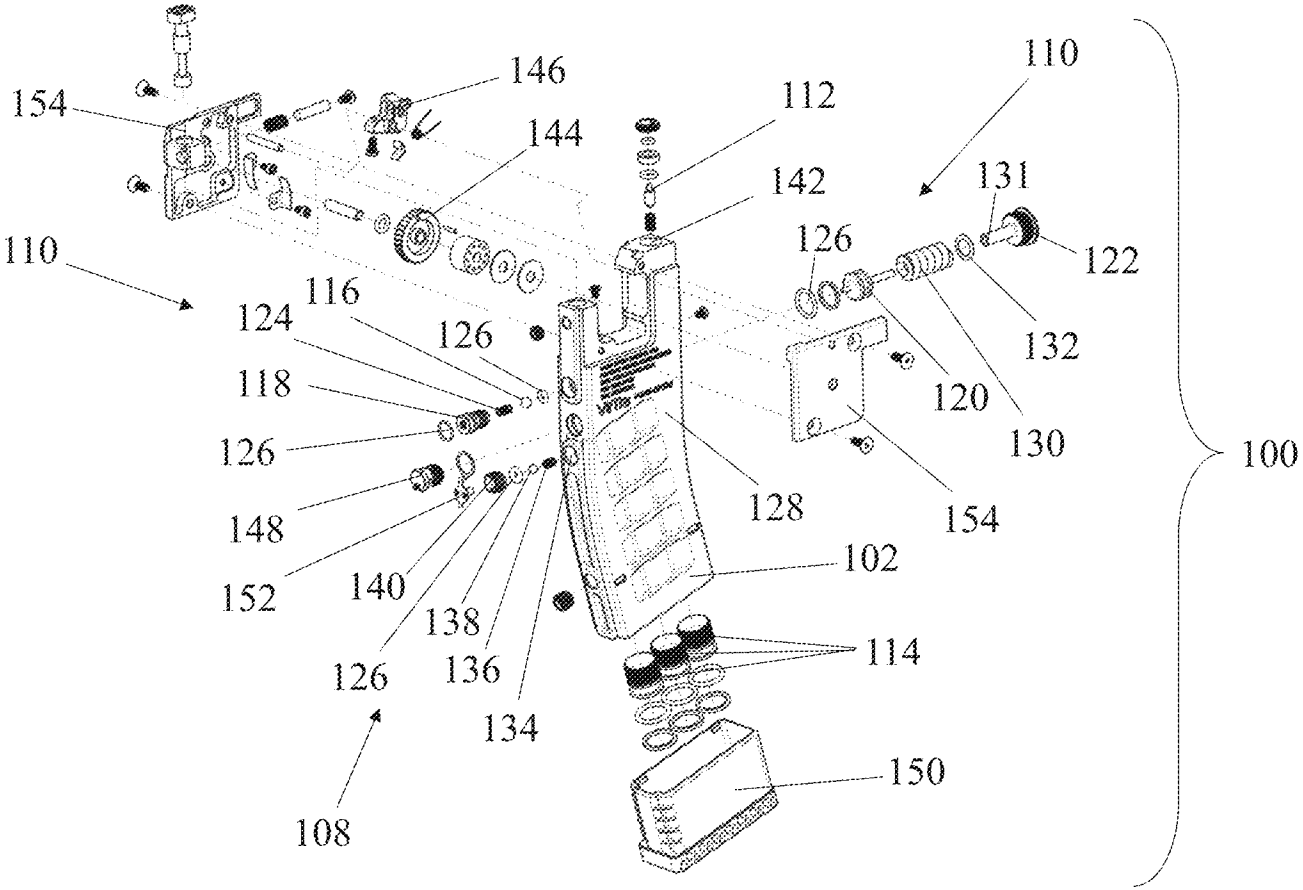
FIG. 4 is an exploded view of the high-pressure air magazine shown in FIG. 2.

The fill valve 108 is disposed between the high-pressure chamber 104 and a fill port 134 exposed on a surface 128 of the outer housing 102 and may be any fill valve known in the industry for handling high pressure air. The fill valve 108 is configured to couple with a high-pressure nozzle through the fill port 134 to fill the high-pressure chamber 104 with pressurized air. Thus, the high-pressure air magazine 100 can be coupled with a tank of pressurized air to recharge the high-pressure air magazine 100. As illustrated in FIGS. 4-5, the fill valve 108 may include a compression spring 136 and a ball or bearing 138. The compression spring 136 may press the ball or bearing 138 against an O-ring 126 that surrounds the fill port 134 to restrict air from escaping the high-pressure chamber 104. An externally threaded retaining nut 140 may be screwed into the fill port 134 to provide a seat for the O-ring 126 when the ball or bearing 138 is pressed against the fill port 134 by the compression spring 136 and the pressure within the high-pressure chamber 104. Thus, air is restricted from escaping through the fill valve 108, but air can be inserted into the high-pressure chamber 104 by pressing the high-pressure nozzle into the fill valve 108, thus moving the ball or bearing 138 from its closed position and allowing air to enter the high-pressure chamber 104. The seat provided by the externally threaded retaining nut 140 for the O-ring 126 surrounding the fill port 134 may be flat, as shown in FIG. 5. The flat seat decreases the likelihood of the fill valve 108 locking up.

The air release valve 112 is disposed between the low-pressure chamber 106 and an air release port 142. The air release port 142 is exposed on the surface 128 of the outer housing 102. The air release valve 112 is configured to couple with the firearm 10 or the recoil kit 20 and dispense a burst of air from the low-pressure chamber 106 to the firearm 10 when the firearm 10 is activated, such as by pulling the trigger. The burst of air causes the firearm 10 to simulate a recoil of the firearm 10.

The high-pressure air magazine 100 may also comprise a counter 144 configured to track a number of bursts of air released through the air release valve 112. The counter 144 allows the high-pressure air magazine 100 to behave like a conventional magazine that runs out of rounds. For example, a conventional magazine may have capacity for 30 rounds, and, after 30 shots, locks out and must be refilled or replaced. The counter allows the high-pressure air magazine 100 to lock out after a predetermined number of shots. Thus, in some embodiments, when the number of bursts counted by the counter 144 reaches a predetermined level, the high-pressure air magazine 100 may lock out and restrict airflow out of the air release valve 112. To continue activating the firearm 10, the trainee would need to detach the high-pressure air magazine 100 from the firearm 10 and replace it with a high-pressure air magazine 100 that has not been completely discharged or that has been refilled. Once the high-pressure chamber 104 is refilled with pressurized air through the fill valve 108, the counter 144 may be reset and the high-pressure air magazine 100 may be reused.

To use a high-pressure air magazine 100 in a firearm 10, the firearm 10 may be configured with the recoil kit 20 in place of the live fire bolt assembly. The recoil kit 20 has a cylindrically shaped nipple which engages the air release valve 112, creating an air-tight seal. With the recoil kit 20 installed into the firearm 10, air can be fed from the low-pressure chamber 106 into the recoil kit 20 of the firearm 10, allowing the firearm 10 to be fired. When the user pulls the trigger, the burst of air from the low-pressure chamber 106 of the high-pressure air magazine 100 and recoil kit 20 is expelled into the firearm 10, forcefully pushing the bolt of the firearm 10 rearward, simulating a recoil. As the bolt returns forward, it activates the counter 144. The counter 144 indexes on every shot until the maximum round count has been reached. Upon reaching the maximum round count, the counter 144 releases a jamming pin 146, which retains the bolt of the firearm 10 in an open position, simulating an out of ammunition condition.

During each shot cycle of the firearm 10, the low-pressure chamber 106 releases the pressurized air within the low-pressure chamber 106, allowing the regulator piston 120 to be pressed toward the regulator ball valve 116 by the primary regulator spring 130 and open the regulator ball valve 116. Once the regulator ball valve 116 is open, the high-pressure chamber 104 replenishes the low-pressure chamber 106. This cycle is repeated until the jamming pin 146 is activated. The jamming pin 146 releases a spring-loaded catch that tricks the firearm 10 into which the high-pressure air magazine 100 is installed into thinking that the magazine is out of ammunition. The jamming pin 146 does not interfere with the pressure equilibrium of the high-pressure air magazine 100.

The high-pressure air magazine 100 may also comprise a burst disk 148 disposed between the high-pressure chamber 104 and the surface 128 of the outer housing 102. The burst disk 148 is a safety feature for the high-pressure air magazine 100. Because high pressures are used in the high-pressure air magazine 100, the high-pressure air magazine 100 may rupture, destroying the high-pressure air magazine 100 and possibly causing injury to the user. The burst disk 148 is configured to fail when the pressure within the high-pressure chamber 104 reaches a predetermined maximum pressure and allow air to exit from the high-pressure chamber 104. Thus, dangerous levels of pressure within the high-pressure chamber 104 may be avoided.

The firearm 10 often has a defined rate of fire that must be maintained in order to simulate live fire conditions. The speed and air flow rate of the air regulator 110 is critical to achieve the desired rate of fire. Orifices which connect the high-pressure chamber 104, the air regulator 110, the low-pressure chamber 106, and the air release valve 112 are a critical part of allowing enough air flow. If the orifice is too small, or has imperfections (like burrs), the low-pressure chamber 106 cannot be replenished fast enough. If this happens, the timing of the firearm 10 will be off, creating a malfunction. It is also the flow and pressure combined which create a strong recoil force. By adjusting the orifice diameters, the cycle rate of the firearm 10 into which the high-pressure air magazine 100 is installed can be adjusted. For example, a wider air passage refills the low-pressure chamber 106 faster, thus allowing the firearm 10 to fire sooner. Conversely, a narrower air passage refills the low-pressure chamber 106 slower, slowing the cycle rate. In this way, the high-pressure air magazine 100 can be customized to match the firing cycle rate for the specific firearm 10 for which it is designed to achieve a more realistic training experience.

The high-pressure air magazine 100 may also comprise a protective rubber boot 150 configured to protect the end of the high-pressure air magazine 100 distal to the firearm 10 from an impact in the event that the user drops the firearm 10 during use. Additionally, the fill port 134 may be covered by a removable dust cover 152 to limit the amount of dust or other particles which gathers near the fill port 134 during use. This, in turn, limits the amount of dust that could get sucked into the high-pressure chamber 104 when the high-pressure chamber 104 is refilled. The high-pressure air magazine 100 may also comprise a plurality of steel plates 154 configured to protect the high-pressure air magazine adjacent to the firearm 10 from an impact in the event that the user drops the high-pressure air magazine 100 when the high-pressure air magazine 100 is disconnected from the firearm 10. This allows the high-pressure air magazine 100 to be formed of a lighter material without sacrificing the durability of the high-pressure air magazine 100.

It will be understood that implementations of a high-pressure air magazine are not limited to the specific assemblies, devices and components disclosed in this document, as virtually any assemblies, devices and components consistent with the intended operation of a high-pressure air magazine may be used. Accordingly, for example, although particular high-pressure air magazines, and other assemblies, devices and components are disclosed, such may include any shape, size, style, type, model, version, class, measurement, concentration, material, weight, quantity, and/or the like consistent with the intended operation of high-pressure air magazines. Implementations are not limited to uses of any specific assemblies, devices and components; provided that the assemblies, devices and components selected are consistent with the intended operation of a high-pressure air magazine.

Accordingly, the components defining any high-pressure air magazine may be formed of any of many different types of materials or combinations thereof that can readily be formed into shaped objects provided that the materials selected are consistent with the intended operation of a high-pressure air magazine. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various high-pressure air magazines may be manufactured using conventional procedures as added to and improved upon through the procedures described here. Some components defining a high-pressure air magazine may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that methods for manufacturing or assembling high-pressure air magazines are not limited to the specific order of steps as disclosed in this document. Any steps or sequence of steps of the assembly of a high-pressure air magazine indicated herein are given as examples of possible steps or sequence of steps and not as limitations, since various assembly processes and sequences of steps may be used to assemble high-pressure air magazines.

The implementations of a high-pressure air magazine described are by way of example or explanation and not by way of limitation. Rather, any description relating to the foregoing is for the exemplary purposes of this disclosure, and implementations may also be used with similar results for a variety of other applications employing a high-pressure air magazine.

What is claimed is:

1. A high-pressure air magazine, comprising:

an outer housing formed of a single piece of material that is sized and shaped to couple with a recoil kit for a firearm, the outer housing formed of aluminum and having a leading end configured to fit into a magazine well of a firearm, and a side surface extending from the leading end to a rear end of the outer housing, wherein the outer housing is configured to withstand a pressure of 7000 psi within the outer housing;

a high-pressure chamber formed within the outer housing and sized to hold a predetermined quantity of pressurized air, the high-pressure chamber having a first end adjacent the leading end and formed with a rounded, semi-spherical surface, a second end adjacent the rear end of the high-pressure chamber having a chamber plug with a second rounded, semi-spherical surface therein such that when the chamber plug is coupled to the high-pressure air magazine, the high-pressure chamber is rounded at both the first end and the second end;

a fill valve disposed between the high-pressure chamber and a fill port exposed on a side surface of the outer housing, the fill valve configured to couple with a high-pressure nozzle through the fill port to fill the high-pressure chamber with pressurized air, the fill port extending perpendicularly through the side surface and into a side of the high-pressure chamber between the first end and the second end;

an air regulator fluidly coupled to the high-pressure chamber within the outer housing and configured to selectively pass air from the high-pressure chamber to a low-pressure chamber within the outer housing, the air regulator comprising:

a regulator ball valve positioned between the high-pressure chamber and the low-pressure chamber, the regulator ball valve comprising a regulator ball biased by a compression spring to a closed position against an o-ring wherein airflow from the high-pressure chamber to the low-pressure chamber is minimized;

a regulator valve screw exposed on the surface of the outer housing and configured to adjust a magnitude of the bias on the regulator ball created by the compression spring;

a regulator piston exposed to the low-pressure chamber and in contact with the regulator ball valve, wherein when a pressure within the low-pressure chamber lowers past a predetermined pressure, the regulator piston is biased by a primary regulator spring to push the regulator ball valve from the closed position to an open position wherein air flows from the high-pressure chamber to the low-pressure chamber until the pressure within the low-pressure chamber reaches the predetermined pressure; and a regulator piston support nut exposed on the surface of the outer housing and configured to adjust the predetermined pressure by adjusting a magnitude of the bias on the regulator piston created by the primary regulator spring;

an air release valve disposed between the low-pressure chamber and an air release port exposed on the surface of the outer housing, the air release valve configured to couple with the recoil kit and dispense a burst of air from the low-pressure chamber to the firearm through the recoil kit when the firearm is activated, wherein the burst of air causes the firearm to simulate a recoil of the firearm; and a counter configured to track a number of bursts of air released through the air release valve.

2. The high-pressure air magazine of claim 1, further comprising a burst disk disposed between the high-pressure chamber and the surface of the outer housing, the burst disk configured to fail when the pressure within the high-pressure chamber reaches a predetermined maximum pressure and allow air to exit from the high-pressure chamber.

3. The high-pressure air magazine of claim 1, the air regulator further comprising a secondary regulator spring in series with the primary regulator spring, wherein the secondary regulator spring increases the incremental precision with which the predetermined pressure can be adjusted.

4. The high-pressure air magazine of claim 1, further comprising the firearm and the recoil kit, wherein the recoil kit is coupled to a magazine well of the firearm, and the outer housing is coupled to the recoil kit.

5. The high-pressure air magazine of claim 1, wherein when the number of bursts reaches a predetermined level, the high-pressure air magazine restricts airflow out of the air release valve until the high-pressure air magazine is detached from the recoil kit and the high-pressure chamber is refilled with pressurized air through the fill valve.

6. A high-pressure air magazine, comprising:

an outer housing sized and shaped to couple with a recoil kit for a firearm;

at least one high-pressure chamber formed within the outer housing, having a chamber plug within the outer housing at one end of the at least one high-pressure chamber, and sized to hold a predetermined quantity of pressurized air;

an air regulator fluidly coupled to the high-pressure chamber within the outer housing and configured to selectively pass air from the high-pressure chamber to a low-pressure chamber within the outer housing, the air regulator comprising:

a regulator ball valve positioned between the high-pressure chamber and the low-pressure chamber, the regulator ball valve comprising a regulator ball biased to a closed position against an o-ring wherein airflow from the high-pressure chamber to the low-pressure chamber is minimized; and a regulator piston exposed to the low-pressure chamber and configured to contact the regulator ball valve, wherein when a pressure within the low-pressure chamber lowers past a predetermined pressure, the regulator piston is biased to push the regulator ball valve from the closed position to an open position wherein air flows from the high-pressure chamber to the low-pressure chamber until the pressure within the low-pressure chamber reaches the predetermined pressure;

an air release valve fluidly coupled to the low-pressure chamber and configured to dispense a burst of air from the low-pressure chamber to the firearm when the firearm is activated, wherein the burst of air causes the firearm to simulate a recoil of the firearm; and a counter configured to track a number of bursts of air released through the air release valve;

wherein the outer housing formed of a single piece of aluminum is configured to withstand a pressure of 7000 psi within the outer housing.

7. The high-pressure air magazine of claim 6, the air regulator further comprising a regulator valve screw exposed on the surface of the outer housing and configured to adjust a magnitude of the bias on the regulator ball valve created by the compression spring.

8. The high-pressure air magazine of claim 6, the air regulator further comprising a regulator piston support nut exposed on the surface of the outer housing and configured to adjust the predetermined pressure by adjusting a magnitude of the bias on the regulator piston created by the primary regulator spring.

9. The high-pressure air magazine of claim 6, the high pressure chamber having a first end adjacent a leading end of the outer housing, the first end formed with a rounded surface, a second end adjacent the rear end of the outer housing, wherein the chamber plug being positioned within the second end of the high pressure chamber and having a second rounded surface therein such that when the chamber plug is coupled to the outer housing of the high-pressure air magazine, the high-pressure chamber is rounded at both the first end and the second end.

10. The high-pressure air magazine of claim 9, wherein the first end rounded surface is a semi-spherical surface.

11. A high-pressure air magazine, comprising:

at least one high-pressure chamber formed within an aluminum outer housing, the aluminum outer housing formed of a single piece of aluminum configured to withstand a pressure of 7000 psi within the outer housing;

an air regulator fluidly coupled to the high-pressure chamber within the outer housing and configured to selectively pass air from the high-pressure chamber to a low-pressure chamber within the outer housing, the air regulator comprising a regulator piston exposed to the low-pressure chamber and in contact with a regulator ball valve comprising a regulator ball, wherein when a pressure within the low-pressure chamber lowers past a predetermined pressure, the regulator piston is biased to push the regulator ball from a closed position against an o-ring wherein airflow from the high-pressure chamber to the low-pressure chamber is minimized to an open position wherein air flows from the high-pressure chamber to the low-pressure chamber; and an air release valve fluidly coupled to the low-pressure chamber and configured to dispense a burst of air from the low-pressure chamber to a firearm when the firearm is activated, wherein the burst of air causes the firearm to simulate a recoil of the firearm.

12. The high-pressure air magazine of claim 11, wherein the regulator ball is biased to the closed position.

13. The high-pressure air magazine of claim 12, the air regulator further comprising a regulator valve screw exposed on a surface of the outer housing and configured to adjust a magnitude of the bias on the regulator ball.

14. The high-pressure air magazine of claim 11, further comprising a counter configured to track a number of bursts of air released through the air release valve, wherein when the number of bursts reaches a predetermined level, the high-pressure air magazine restricts airflow out of the air release valve until the high-pressure air magazine is detached from the recoil kit and the high-pressure chamber is refilled with pressurized air through the fill valve.

15. The high-pressure air magazine of claim 11, the air regulator further comprising a regulator piston support nut exposed on a surface of the outer housing and configured to adjust the predetermined pressure by adjusting a magnitude of the bias on the regulator piston.

16. The high-pressure air magazine of claim 11, further comprising the firearm and a recoil kit for the firearm, wherein the recoil kit is coupled to a magazine well of the firearm, and the outer housing is coupled to the recoil kit.

17. The high-pressure air magazine of claim 11, further comprising a fill valve disposed between the high-pressure chamber and a fill port extending perpendicularly through a side surface of the outer housing, the fill valve configured to couple with a high-pressure nozzle through the fill port to fill the high-pressure chamber with pressurized air.

18. The high-pressure air magazine of claim 11, further comprising a burst disk disposed between the high-pressure chamber and a surface of the outer housing, the burst disk configured to fail when the pressure within the high-pressure chamber reaches a predetermined maximum pressure and allow air to exit from the high-pressure chamber.

19. The high-pressure air magazine of claim 11, wherein the at least one high pressure chamber having a first end closest to a leading end of the outer housing, the first end formed with a rounded surface, and a second end closest to a rear end of the outer housing and having a chamber plug separate from the outer housing with a second rounded surface therein such that when the chamber plug is coupled to the outer housing of the high-pressure air magazine, the high-pressure chamber is rounded at both the first end and the second end.

20. The high-pressure air magazine of claim 19, wherein the first end rounded surface is a semi-spherical surface.

* * * * *